US006942411B2

(12) United States Patent
Kato

(10) Patent No.: US 6,942,411 B2
(45) Date of Patent: Sep. 13, 2005

(54) TELESCOPIC BALL-POINT PEN

(75) Inventor: Hiroyasu Kato, Gunma-ken (JP)

(73) Assignee: Katoh Kinzoku Kogyo Kabushiki Kaisha, Tomioka (JP)

( * ) Notice: Subject to any disclaimer, the term of this patent is extended or adjusted under 35 U.S.C. 154(b) by 0 days.

(21) Appl. No.: 10/960,459

(22) Filed: Oct. 6, 2004

(65) Prior Publication Data

US 2005/0078999 A1 Apr. 14, 2005

(30) Foreign Application Priority Data

Oct. 6, 2003 (JP) ..... 2003-346644

(51) Int. Cl.[7] ..... B43K 5/16
(52) U.S. Cl. ..... 401/116; 401/99
(58) Field of Search ..... 401/99, 116, 117

(56) References Cited

U.S. PATENT DOCUMENTS

| | | | | |
|---|---|---|---|---|
| 3,597,100 | A * | 8/1971 | Ganz | 401/110 |
| 4,601,599 | A | 7/1986 | Katoh | |
| 6,474,889 | B2 | 11/2002 | Kato | |

FOREIGN PATENT DOCUMENTS

| | | |
|---|---|---|
| JP | 60-199698 | 10/1985 |
| JP | 60-199699 | 10/1985 |
| JP | 61-202894 | 9/1986 |
| JP | 2-21398 | 5/1990 |
| JP | 4-27670 | 7/1992 |
| JP | 6-27433 | 7/1994 |
| JP | 6-34156 | 9/1994 |
| JP | 7-32132 | 7/1995 |
| JP | 2509549 | 6/1996 |
| JP | 10-157383 | 6/1998 |
| JP | 2003-127587 | 5/2003 |

* cited by examiner

*Primary Examiner*—David J. Walczak
(74) *Attorney, Agent, or Firm*—Christensen O'Connor Johnson Kindness PLLC

(57) ABSTRACT

A telescopic ball-point pen includes a tubular body, including a sliding axial tube, which in turn includes a refill tank. An interior surface of the body and an exterior surface of the sliding axial tube are threaded to form a driver screw portion, and an interior surface of the sliding axial tube and an exterior surface of the refill tank are threaded to form a follower screw portion. A pitch of the follower screw portion is greater than that of the driver screw portion so that the amount of front-and-back movement of the refill tank is greater than that of the sliding axial tube per rotation. A rear end of the sliding axial tube is fixed to a sheath. When the sheath and the body are rotated, the tip of a ball-point pen refill removably received within the refill tank is projected beyond, or received within, the pen.

2 Claims, 4 Drawing Sheets

TELESCOPIC BALL-POINT PEN

FIELD OF THE INVENTION

The present invention is related to a telescopic ball-point pen.

BACKGROUND OF THE INVENTION

With a conventional telescopic ball-point pen, when the pen is not in use, its frontal axial portion and rear axial portion are moved closer together, thereby engageably striking an internal push rod with a sliding tip portion, so that the sliding tip portion is projected to a position to thereby conceal a tip of a ball-point pen refill. When the pen is in use, the frontal axial portion and the rear axial portion are moved away from each other, thereby disengaging the push rod from the sliding tip portion, so that the sliding tip portion is retracted to a position to expose the tip of a ball-point pen refill.

Construction of this type of telescopic ball-point pen requires high-precision machining, with a relatively low yield. Further, the assembly work required tends to be complex and costly.

SUMMARY OF THE INVENTION

The present invention provides a telescopic ball-point pen in which the telescopic motion is effected by rotating components that are screwed or threaded onto each other, so as to permit high-yield machining and relatively easy assembly of the pen.

A telescopic ball-point pen includes a tubular body, to one end of which a mouth ring is removably attached. The tubular body includes therein a sliding axial tube, which in turn includes a refill tank. An interior surface of the body and a corresponding exterior surface of the sliding axial tube are threaded to form a driver screw portion, which permits the sliding axial tube to slide back and forth within the body. An interior surface of the sliding axial tube and a corresponding exterior surface of the refill tank are threaded to form a follower screw portion, which permits the refill tank to slide back and forth within the sliding axial tube. The pitch of the follower screw portion is greater than that of the driver screw portion so that the amount of front-and-back movement of the refill tank is greater than that of the sliding axial tube per rotation. A ball-point pen refill is removably received within a refill tank so that its pen tip can be projected beyond, or received within, a distal end of the mouth ring. At a rear end of the sliding axial tube, a sheath and a head cap are provided, both of which are configured to rotationally slide along a connection portion of the body. When the sheath and the body are rotated, they are moved away from each other or closer together and, at the same time, the pen tip of the ball-point pen refill within the refill tank is projected beyond or received within the mouth ring.

Accordingly, the present invention provides a telescopic ball-point pen in which the telescopic motion is effected by simply rotating components that are screwed or threaded onto each other, and thus the pen can be readily put to use for writing. Further, the threaded construction permits high-yield machining and relatively easy assembly of the pen.

BRIEF DESCRIPTION OF THE DRAWINGS

The foregoing aspects and many of the attendant advantages of this invention will become more readily appreciated when taken in conjunction with the accompanying drawings, wherein.

DETAILED DESCRIPTION OF THE PREFERRED EMBODIMENTS

Figure 1:
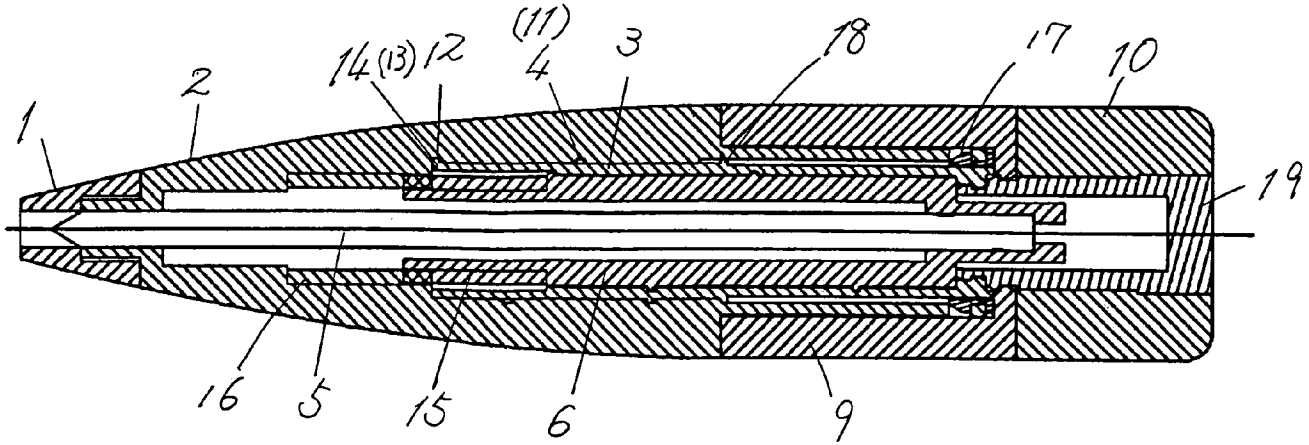
FIG. 1 is a cross-sectional view of a screw-type telescopic ball-point pen when it is shortened or retracted, in accordance with one embodiment of the present invention.

A telescopic ball-point pen includes a body 2, to one end of which a mouth ring 1 is removably attached. An interior surface of the body 2 and a corresponding exterior surface of a sliding axial tube 3 form a driver screw portion 4, which permits the sliding axial tube to slide back and forth within the body 2. An interior surface of the sliding axial tube 3 and a corresponding exterior surface of a refill tank 6 form a follower screw portion 7, which permits the refill tank 6 to slide back and forth within the sliding axial tube 3. The pitch of the follower screw portion 7 is greater than that of the driver screw portion 4 so that the amount of front-and-back movement of the refill tank 6 is greater than that of the sliding axial tube 3 per rotation. A ball-point pen refill 5 is removably received within the refill tank 6 so that its pen tip 5' can be projected beyond, or received within, a distal end of the mouth ring 1. At a rear end of the sliding axial tube 3, a sheath 9 and a head cap 10 are provided, both of which are configured to rotationally slide along a connection portion 8 of the body 2. When the sheath 9 and the body 2 are rotated, they are moved away from each other, or closer together, and at the same time, the pen tip 5' of the ball-point pen refill 5 within the refill tank 6 is projected beyond, or received within, the mouth ring 1.

Figure 2:
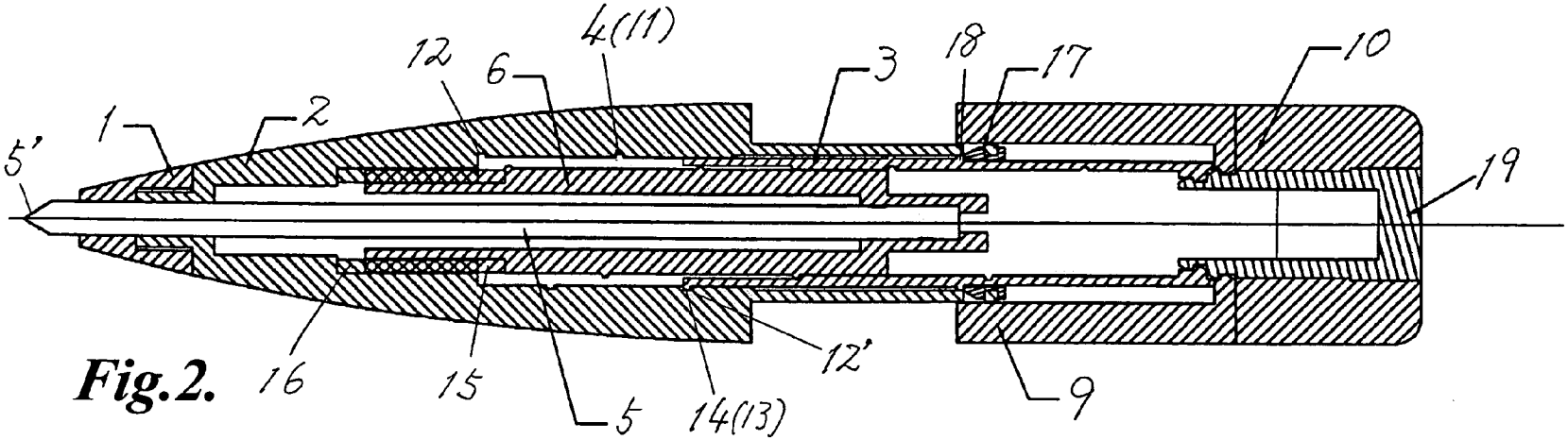
FIG. 2 is a cross-sectional view of the screw-type telescopic ball-point pen of FIG. 1 when it is extended.
Figure 3:
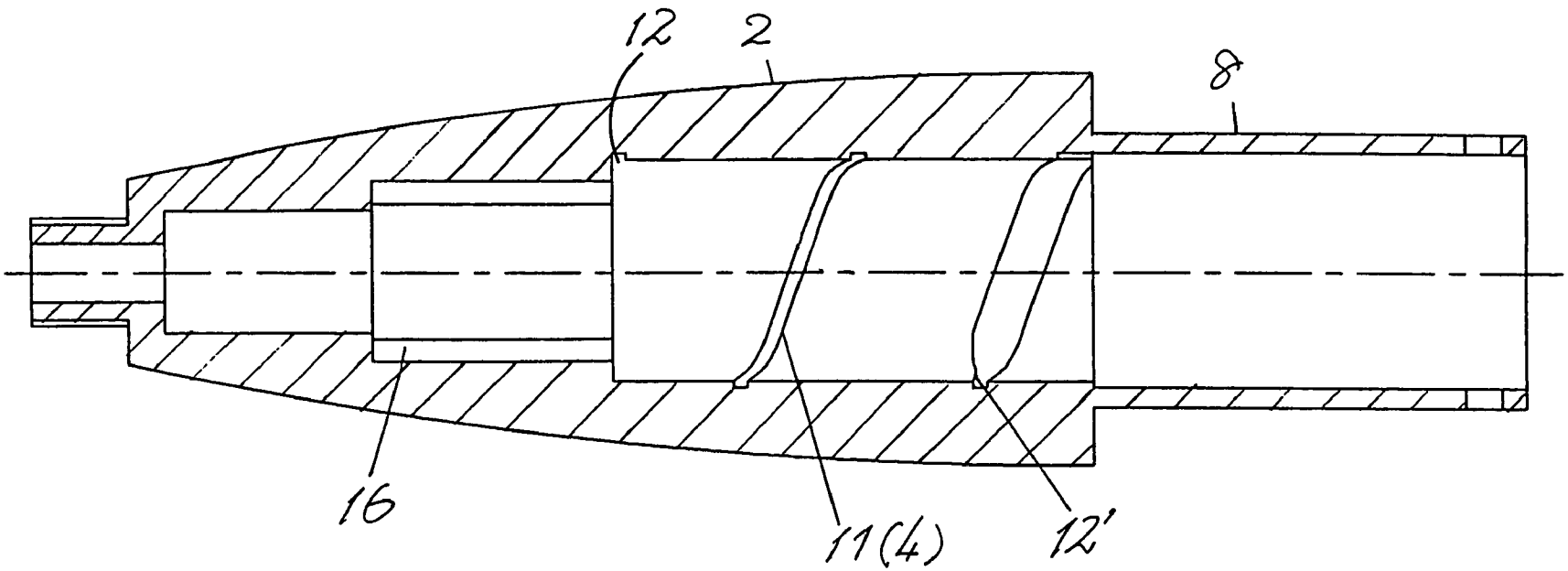
FIG. 3 is a cross-sectional view of a body of the screw-type telescopic ball-point pen of FIG. 1.
Figure 4:
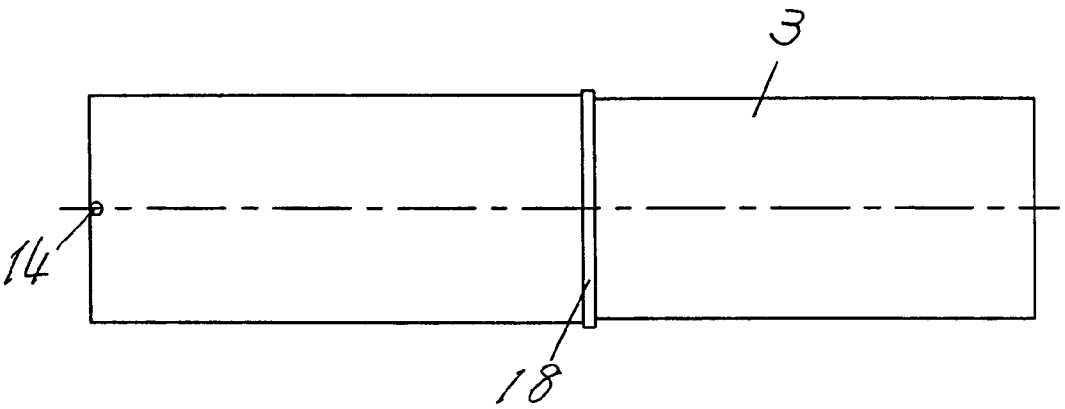
FIG. 4 is a frontal view of a sliding axial tube, in accordance with one embodiment of the present invention.
Figure 5:
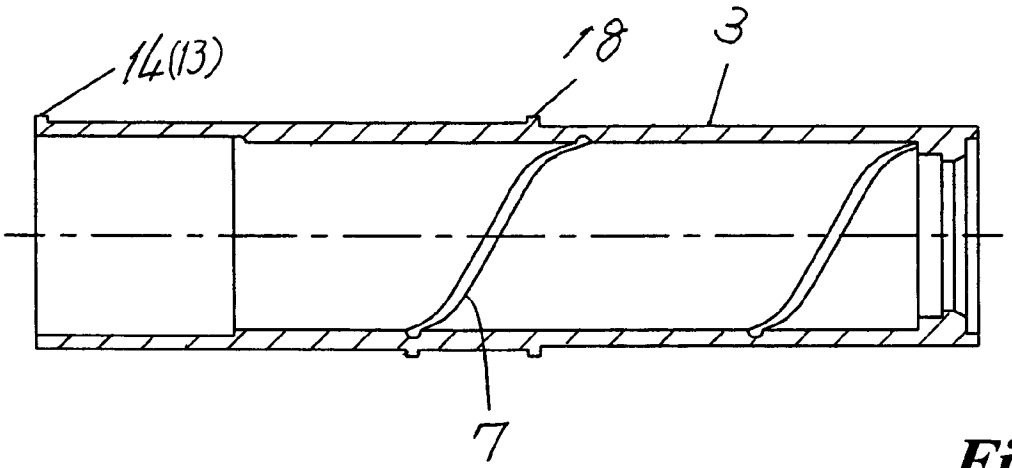
FIG. 5 is a cross-sectional view of the sliding axial tube of FIG. 4.
Figure 6:
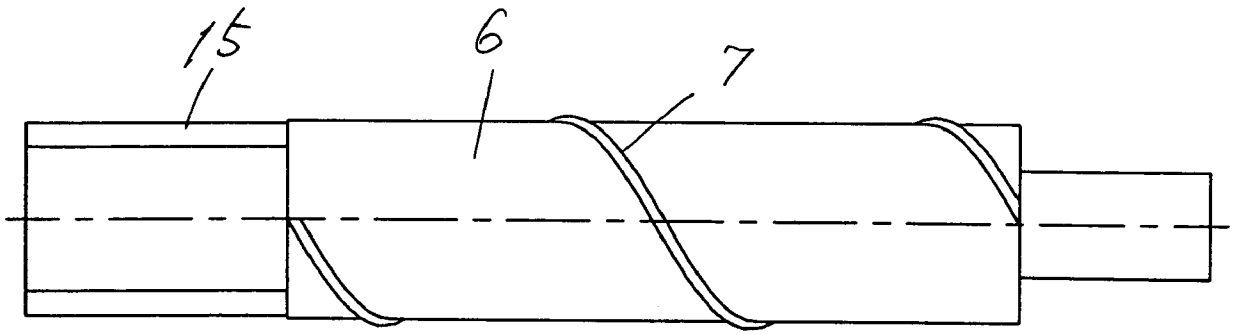
FIG. 6 is a frontal view of a refill tank, in accordance with one embodiment of the present invention.
Figure 7:
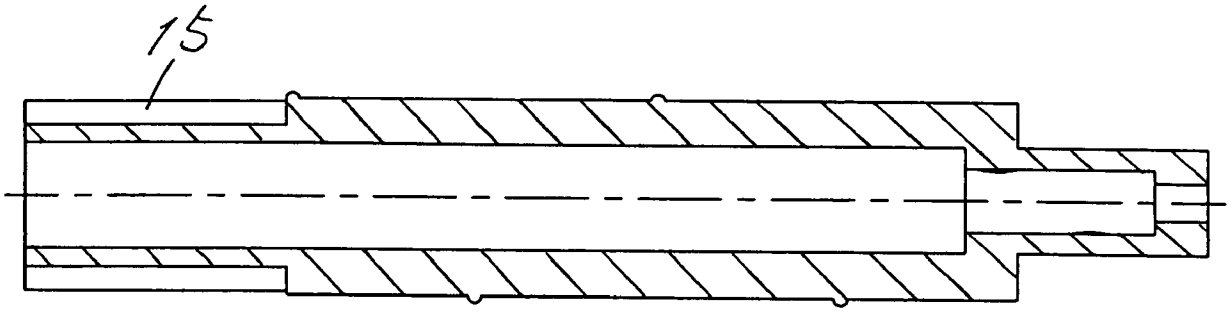
FIG. 7 is a cross-sectional view of the refill tank of FIG. 6.

In one embodiment, the ratio between the pitch of the driver screw portion 4 and the pitch of the follower screw portion 7 is set as 1:1.4. When a telescopic ball-point pen is shortened or retracted as shown in FIG. 1, a user can rotate the body 2 and the sheath 9 so as to separate the body 2 and the sheath 9 away from each other to thereby extend the pen, as shown in FIG. 2.

The beginning end and the terminal end of an internal thread 11 of the driver screw portion 4 include slightly bossed flat lock portions 12 and 12', respectively. An external thread 13, which corresponds to the internal thread 11, includes a projection 14. When the pen is shortened, the projection 14 is received by the beginning end lock portion 12 of the internal thread 11, and when the pen is extended the projection 14 is received by the terminal end lock portion 12' of the internal thread 11, so as to stabilize the pen when it is shortened or extended and to prevent inadvertent extension or shortening of the pen.

The refill tank 6 and the body 2 include a projection 15 and a groove 16, respectively, which are engageable so as to relatively move the refill tank 6 and the body 2 only in the front-and-back direction.

When the pen is extended, a ring 18 strikes a stopper 17 so as to stop the extension movement, and at that time the projection 14 of the external thread 13 is engaged with the terminal end lock portion 12' of the internal thread 11 to prevent any inadvertent extension or shortening movement.

A stop screw 19 fixed to a rear end of the sliding axial tube 3 is provided to fasten the sheath 9 and the head cap 10.

According to the construction described above, all of the main structural components, such as the body 2, the sliding axial tube 3, and the refill tank 6, are tubular, and can be constructed by simply applying threads on their exterior or interior surfaces or portions thereof. Therefore, the construction permits high-yield machining and relatively easy assembly of the pen.

While the preferred embodiments of the invention have been illustrated and described, it will be appreciated that various changes can be made therein without departing from the spirit and scope of the invention.

The embodiments of the invention in which an exclusive property or privilege is claimed are defined as follows:

1. A telescopic ball-point pen, comprising:

a tubular body comprising a connection portion;

a mouth ring removably attached to a distal end of the body;

a sliding axial tube received within the tubular body;

a sheath and a head cap secured to a proximal end of the sliding axial tube, both of which are adapted to rotationally slide along the connection portion of the tubular body;

a tank refill received within the sliding axial tube; and a ball-point pen refill removably received within the refill tank, the ball-point pen refill comprising a pen tip;

wherein an interior surface of the tubular body defines a first internal thread and a corresponding exterior surface of the sliding axial tube defines a first external thread to together form a driver screw portion, which permits the sliding axial tube to move back and forth within the body;

wherein an interior surface of the sliding axial tube defines a second internal thread and a corresponding exterior surface of the refill tank defines a second external thread to together form a follower screw portion, which permits the refill tank to move back and forth within the sliding axial tube;

wherein a pitch of the follower screw portion is greater than the pitch of the driver screw portion so that the amount of front-and-back movement of the refill tank is greater than that of the sliding axial tube per rotation of the tubular body relative to the sheath;

wherein when the sheath and the tubular body are rotated, they are moved away from each other or closer together and, at the same time, the pen tip of the ball-point pen refill within the refill tank is projected beyond or received within the mouth ring.

2. A telescopic ball-point pen, comprising:

a tubular body;

a sliding axial tube received within the tubular body;

a tank refill received within the sliding axial tube; and a ball-point pen refill removably received within the refill tank;

wherein an interior surface of the tubular body defines a first internal thread and a corresponding exterior surface of the sliding axial tube defines a first external thread to together form a driver screw portion, which permits the sliding axial tube to move back and forth within the body;

wherein an interior surface of the sliding axial tube defines a second internal thread and a corresponding exterior surface of the refill tank defines a second external thread to together form a follower screw portion, which permits the refill tank to move back and forth within the sliding axial tube;

wherein a pitch of the follower screw portion is greater than the pitch of the driver screw portion so that the amount of front-and-back movement of the refill tank is greater than that of the sliding axial tube per rotation of the tubular body relative to the sheath;

wherein when the sheath and the tubular body are rotated, they are moved away from each other or closer together and, at the same time, a distal end of the ball-point pen refill within the refill tank is distally projected or proximally retracted.

* * * * *